US006105388A

United States Patent [19]

Acharya et al.

[11] Patent Number: 6,105,388

[45] Date of Patent: Aug. 22, 2000

[54] MULTIPLE CIRCUIT CRYOGENIC LIQUEFACTION OF INDUSTRIAL GAS

[75] Inventors: Arun Acharya, East Amherst; Bayram Arman, Grand Island; Joseph Alfred Weber, Cheektowaga; Vijayaraghavan Srinivasan, Williamsville; Jeffert John Nowobilski, Orchard Park; James Smolarek, Boston; Neno Todorov Nenov, Williamsville, all of N.Y.

[73] Assignee: Praxair Technology, Inc., Danbury, Conn.

[21] Appl. No.: 09/222,810

[22] Filed: Dec. 30, 1998

[51] Int. Cl.[7] ..... F25J 1/00

[52] U.S. Cl. ..... 62/612; 62/613; 62/619

[58] Field of Search ..... 62/612, 613, 619

[56] References Cited

U.S. PATENT DOCUMENTS

| | | | |
|---|---|---|---|
| 3,733,845 | 5/1973 | Lieberman | 62/335 |
| 3,970,441 | 7/1976 | Etzbach et al. | 62/612 |
| 4,274,849 | 6/1981 | Garier et al. | 62/9 |
| 4,325,231 | 4/1982 | Krieger | 62/612 |
| 5,626,034 | 5/1997 | Manley et al. | 62/623 |
| 5,657,643 | 8/1997 | Price | 62/612 |
| 5,729,993 | 3/1998 | Boiarski et al. | 62/175 |

*Primary Examiner*—Ronald Capossela
*Attorney, Agent, or Firm*—Stanley Ktorides

[57] ABSTRACT

A method for more efficiently cooling and liquefying industrial gas wherein refrigeration for the cooling and liquefaction is generated using first and second defined multicomponent refrigerant fluids in separate refrigeration circuits to cover a wide temperature range from ambient to cryogenic temperature.

10 Claims, 2 Drawing Sheets

MULTIPLE CIRCUIT CRYOGENIC LIQUEFACTION OF INDUSTRIAL GAS

TECHNICAL FIELD

This invention relates generally to the liquefaction of industrial gas wherein the gas is brought from ambient temperature to a cryogenic temperature to effect the liquefaction.

BACKGROUND ART

The liquefaction of industrial gas is a power intensive operation. Typically the industrial gas is liquefied by indirect heat exchange with a refrigerant. Such a system, while working well for providing refrigeration over a relatively small temperature range from ambient, is not as efficient when refrigeration over a large temperature range, such as from ambient to a cryogenic temperature, is required. This inefficiency may be addressed by using more than one refrigeration circuit to get to the requisite cryogenic condensing temperature. However, such systems will require a significant power input in order to achieve the desired results.

Accordingly, it is an object of this invention to provide a multiple circuit arrangement whereby industrial gas may be brought from ambient temperature to a colder temperature, especially to a cryogenic liquefaction temperature, which operates with greater efficiency than heretofore available multiple circuit systems.

SUMMARY OF THE INVENTION

The above and other objects, which will become apparent to those skilled in the art upon a reading of this disclosure, are attained by the present invention which is:

A method for cooling an industrial gas comprising:

(A) compressing a first multicomponent refrigerant fluid comprising at least one component from the group consisting of fluorocarbons, hydrofluorocarbons and fluoroethers and at least one component from the group consisting of fluorocarbons, hydrofluorocarbons, fluoroethers and atmospheric gases;

(B) cooling the compressed first multicomponent refrigerant fluid and expanding the cooled compressed first multicomponent refrigerant fluid to generate refrigeration;

(C) warming the expanded first multicomponent refrigerant fluid by indirect heat exchange with the compressed first multicomponent refrigerant fluid to effect said cooling of the compressed first multicomponent refrigerant fluid;

(D) compressing a second multicomponent refrigerant fluid comprising at least one component from the group consisting of fluorocarbons, hydrofluorocarbons and fluoroethers and at least one atmospheric gas;

(E) warming the expanded first multicomponent refrigerant fluid by indirect heat exchange with the compressed second multicomponent refrigerant fluid to cool the compressed second multicomponent refrigerant fluid;

(F) further cooling the cooled compressed second multicomponent refrigerant fluid and expanding the further cooled second multicomponent refrigerant fluid to generate refrigeration;

(G) warming the expanded second multicomponent refrigerant fluid by indirect heat exchange with the compressed second multicomponent refrigerant fluid to effect said further cooling of the compressed second multicomponent refrigerant fluid; and (H) warming the expanded second multicomponent refrigerant fluid by indirect heat exchange with industrial gas to cool said industrial gas.

As used herein the term "non-toxic" means not posing an acute or chronic hazard when handled in accordance with acceptable exposure limits.

As used herein the term "non-flammable" means either having no flash point or a very high flash point of at least 600K.

As used herein the term "non-ozone-depleting" means having zero-ozone depleting potential, i.e. having no chlorine, bromine or iodine atoms.

As used herein the term "normal boiling point" means the boiling temperature at 1 standard atmosphere pressure, i.e. 14.696 pounds per square inch absolute.

As used herein the term "indirect heat exchange" means the bringing of fluids into heat exchange relation without any physical contact or intermixing of the fluids with each other.

As used herein the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for the variable load refrigerant is at least 10° K, preferably at least 20° K and most preferably at least 50° K.

As used herein the term "fluorocarbon" means one of the following: tetrafluoromethane ($CF_4$), perfluoroethane ($C_2F_6$), perfluoropropane ($C_3F_8$), perfluorobutane ($C_4F_{10}$), perfluoropentane ($C_5F_{12}$), perfluoroethene ($C_2F_4$), perfluoropropene ($C_3F_6$), perfluorobutene ($C_4F_8$), perfluoropentene ($C_5F_{10}$), hexafluorocyclopropane (cyclo-$C_3F_6$) and octafluorocyclobutane (cyclo-$C_4F_8$).

As used herein the term "hydrofluorocarbon" means one of the following: fluoroform ($CHF_3$), pentafluoroethane ($C_2HF_5$), tetrafluoroethane ($C_2H_2F_4$), heptafluoropropane ($C_3HF_7$), hexafluoropropane ($C_3H_2F_6$), pentafluoropropane ($C_3H_3F_5$), tetrafluoropropane ($C_3H_4F_4$), nonafluorobutane ($C_4HF_9$), octafluorobutane ($C_4H_2F_8$), undecafluoropentane ($C_5HF_{11}$), methyl fluoride ($CH_3F$), difluoromethane ($CH_2F_2$), ethyl fluoride ($C_2H_5F$), difluoroethane ($C_2H_4F_2$), trifluoroethane ($C_2H_3F_3$), difluoroethene ($C_2H_2F_2$), trifluoroethene ($C_2HF_3$) fluoroethene ($C_2H_3F$), pentafluoropropene ($C_3HF_5$) tetrafluoropropene ($C_3H_2F_4$), trifluoropropene ($C_3H_3F_3$), difluoropropene ($C_3H_4F_2$), heptafluorobutene ($C_4HF_7$), hexafluorobutene ($C_4H_2F_6$) and nonafluoropentene ($C_5HF_9$).

As used herein the term "fluoroether" means one of the following: trifluoromethyoxy-perfluoromethane ($CF_3$—O—$CF_3$), difluoromethoxy-perfluoromethane ($CHF_2$—O—$CF_3$), fluoromethoxy-perfluoromethane ($CH_2F$—O—$CF_3$), difluoromethoxy-difluoromethane ($CHF_2$—O—$CHF_2$), difluoromethoxy-perfluoroethane ($CHF_2—O—C_2F_5$), difluoromethoxy-1,2,2,2-tetrafluoroethane, ($CHF_2—O—C_2HF_4$), difluoromethoxy-1,1,2,2-tetrafluoroethane ($CHF_2—O—C_2HF_4$), perfluoroethoxy-fluoromethane ($C_2F_5—O—CH_2F$), perfluoromethoxy-1,1,2-trifluoroethane ($CF_3—O—C_2H_2F_3$), perfluoromethoxy-1,2,2-trifluoroethane ($CF_3O—C_2H_2F_3$), cyclo-1,1,2,2-tetrafluoropropylether (cyclo-$C_3H_2F_4$—O—), cyclo-1,1,3,3-tetrafluoropropylether (cyclo-$C_3H_2F_4$—O—), perfluoromethoxy-1,1,2,2-tetrafluoroethane ($CF_3—O—C_2HF_4$), cyclo-1,1,2,3,3-pentafluoropropylether (cyclo-$C_3H_5$—O—), perfluoromethoxy-perfluoroacetone ($CF_3—O—CF_2—O—CF_3$), perfluoromethoxy-perfluoroethane ($CF_3—O—C_2F_5$), perfluoromethoxy-1,2,2,2-tetrafluoroethane ($CF_3—O—C_2HF_4$), perfluoromethoxy-2,2,2-trifluoroethane ($CF_3—O—C_2H_2F_3$), cyclo-perfluoromethoxy-perfluoroacetone (cyclo-$CF_2—O—CF_2—O—CF_2$—) and cyclo-perfluoropropylether (cyclo-$C_3F_6$—O).

As used herein the term "atmospheric gas" means one of the following: nitrogen ($N_2$), argon (Ar), krypton (Kr), xenon (Xe), neon (Ne), carbon dioxide ($CO_2$), oxygen ($O_2$) and helium (He).

As used herein the term "low-ozone-depleting" means having an ozone depleting potential less than 0.15 as defined by the Montreal Protocol convention wherein dichlorofluoromethane ($CCl_2F_2$) has an ozone depleting potential of 1.0.

As used herein the term "expansion" means to effect a reduction in pressure.

As used herein the terms "turboexpansion" and "turboexpander" means respectively method and apparatus for the flow of high pressure fluid through a turbine to reduce the pressure and the temperature of the fluid thereby generating refrigeration.

As used herein the term "industrial gas" means nitrogen, oxygen, argon, hydrogen, helium, carbon dioxide, carbon monoxide, methane and fluid mixtures containing two or more thereof.

As used herein the term "cryogenic temperature" means a temperate of 150° K or less.

As used herein the term "refrigeration" means the capability to reject heat from a subambient temperature system to the surrounding atmosphere.

DETAILED DESCRIPTION

The invention comprises, in general, the use of at least two defined mixed refrigerants to efficiently provide refrigeration over a very large temperature range.

Multicomponent refrigerant fluids can provide variable amounts of refrigeration over a required temperature range. The defined multicomponent refrigerant fluids of this invention efficiently provide refrigeration over a very wide temperature range so as to effectively liquefy industrial gases. The first or higher temperature multicomponent refrigerant fluid useful in the practice of this invention comprises at least one component from the group consisting of fluorocarbons, hydrofluorocarbons and fluoroethers and at least one component from the group consisting of fluorocarbons, hydrofluorocarbons, fluoroethers and atmospheric gases. A preferred first multicomponent refrigerant fluid useful in the practice of this invention comprises at least one component from the group consisting of fluorocarbons, hydrofluorocarbons and fluoroethers and at least one atmospheric gas. Another preferred first multicomponent refrigerant fluid useful in the practice of this invention comprises at least one fluoroether and at least one component from the group consisting of fluorocarbons, hydrofluorocarbons, fluoroethers and atmospheric gases. The second or lower temperature multicomponent refrigerant fluid useful in the practice of this invention comprises at least one component, and preferably at least two components, from the group consisting of fluorocarbons, hydrofluorocarbons and fluoroethers and at least one atmospheric gas. A preferred second multicomponent refrigerant fluid useful in the practice of this invention comprises at least two components from the group consisting of fluorocarbons, hydrofluorocarbons and fluoroethers and at least two atmospheric gases. Another preferred second multicomponent refrigerant fluid useful in the practice of this invention comprises at least one fluoroether and at least one atmospheric gas.

An added benefit, in addition to the high efficiency of each of the first and second multicomponent refrigerant mixtures, is that each of these mixtures is non-toxic, non-flammable and non-ozone depleting. In a preferred embodiment of the invention each of the two or more components of each of the first and second multicomponent refrigerant mixtures has a normal boiling point which differs by at least 5 degrees Kelvin from the normal boiling point of every other component in that refrigerant mixture. This enhances the effectiveness of providing refrigeration over a wide temperature range which encompasses cryogenic temperatures. In another preferred embodiment of the invention, the normal boiling point of the highest boiling component of each of the first and second multicomponent refrigerant mixture is at least 50 degrees Kelvin greater than the normal boiling point of the lowest boiling component of that multicomponent refrigerant mixture.

Figure 1:
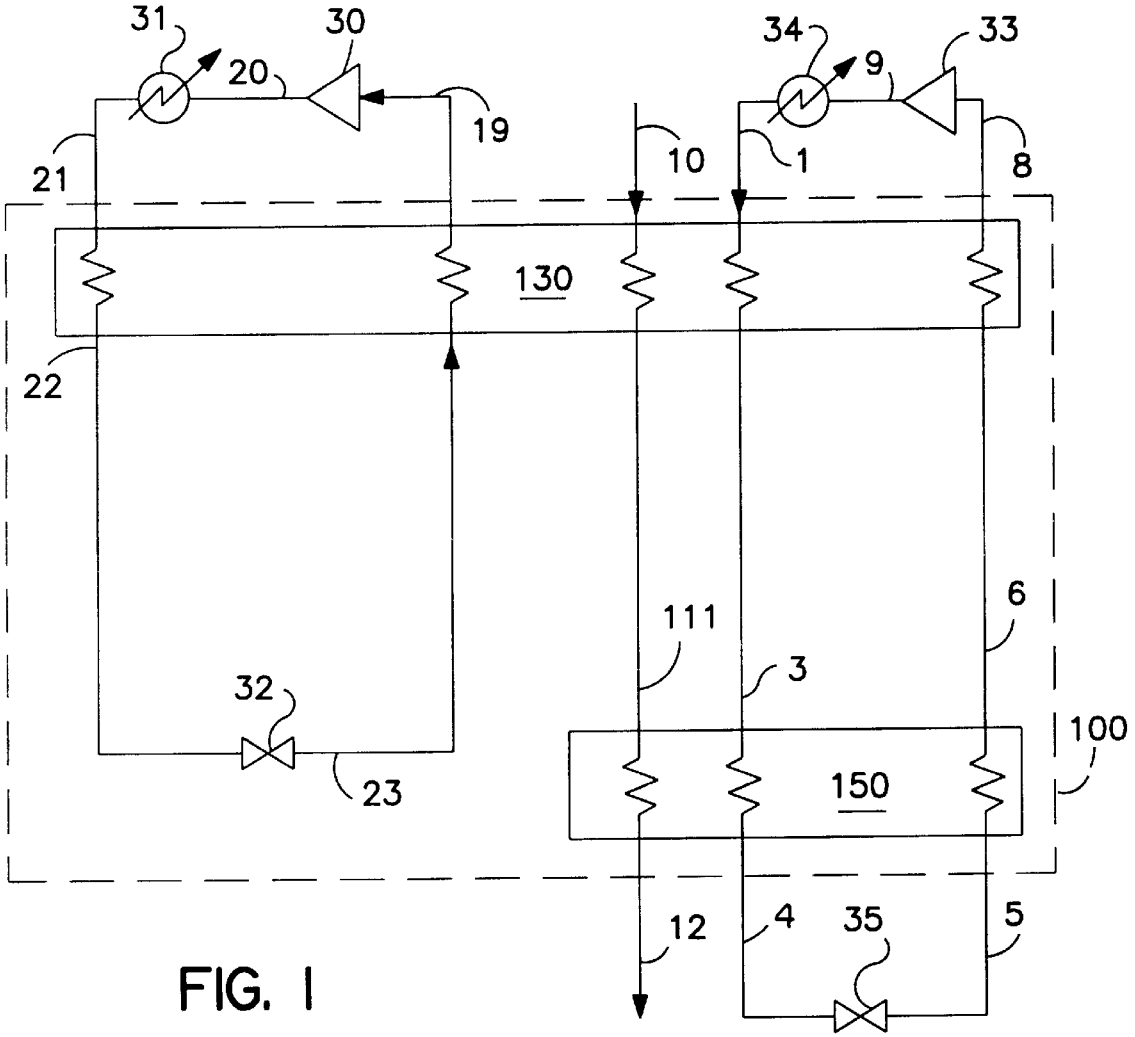
FIG. 1 is a schematic flow diagram of one preferred embodiment of the multiple circuit industrial gas liquefaction system of this invention wherein the industrial gas is cooled by indirect heat exchange with both of the mixed refrigerants.

The invention will be described further with reference to the Drawings. Referring now to FIG. 1, first multicomponent refrigerant fluid 19 is compressed by passage through compressor 30 to a pressure generally within the range of from 100 to 600 pounds per square inch absolute (psia). Compressed first multicomponent refrigerant fluid in line 20 is cooled of the heat of compression in aftercooler 31 wherein it is preferably partially condensed, and resulting first multicomponent refrigerant fluid 21 is passed through heat exchanger 130 wherein it is further cooled and preferably completely condensed. Resulting first multicomponent refrigerant liquid 22 is throttled through valve 32 wherein it is expanded to a pressure generally within the range of from 15 to 50 psia to generate refrigeration. The pressure expansion of the fluid through valve 32 provides refrigeration by the Joule-Thomson effect, i.e. lowering of the fluid temperature due to pressure reduction at constant enthalpy. Typically the temperature of expanded first multicomponent refrigerant fluid 23 will be within the range of from 200 to 250° K. The expansion of the first multicomponent refrigerant fluid through valve 32 also generally causes a portion of this fluid to vaporize.

Refrigeration bearing first multicomponent refrigerant fluid in stream 23 is then passed through heat exchanger 130 wherein it is warmed and completely vaporized thus serving by indirect heat exchange to cool the compressed first multicomponent refrigerant fluid 21. The resulting warmed first multicomponent refrigerant fluid in vapor stream 19, which is generally at a temperature within the range of from 280 to 320° K, is recycled to compressor 30 and the higher temperature refrigeration cycle starts anew.

Second multicomponent refrigerant fluid 8 is compressed by passage through compressor 33 to a pressure generally within the range of from 100 to 600 psia. Compressed second multicomponent refrigerant fluid 9 is cooled of the heat of compression in aftercooler 34. Second multicomponent refrigerant fluid 1 is passed from aftercooler 34 through heat exchanger 130 wherein it is cooled by indirect heat exchange with the aforesaid warming expanded first multicomponent refrigerant fluid. Resulting cooled compressed second multicomponent refrigerant fluid 3, which may be partially condensed, is further cooled and preferably completely condensed by passage through heat exchanger 150. Resulting second multicomponent refrigerant fluid 4 is then throttled through valve 35 wherein it is expanded to a pressure generally within the range of from 15 to 100 psia to generate refrigeration by the Joule-Thomson effect. Typically the temperature of the expanded second multicomponent refrigerant fluid 5 will be within the range of from 80 to 120° K. The expansion of the second multicomponent refrigerant fluid through valve 35 also generally causes a portion of this fluid to vaporize.

Refrigeration bearing second multicomponent refrigerant fluid 5 is then passed through heat exchanger 150 wherein it is warmed by indirect heat exchange with cooling and preferably liquefying industrial gas and wherein it is warmed by indirect heat exchange with cooled compressed second multicomponent refrigerant fluid to effect the further cooling thereof. Resulting second multicomponent refrigerant fluid is passed from heat exchanger 150 in stream 6 through heat exchanger 130 wherein it is warmed by indirect heat exchange with cooling compressed second multicomponent refrigerant fluid and also by indirect heat exchange with cooling industrial gas. The resulting warmed second multicomponent refrigerant fluid in vapor stream 8, which is generally at a temperature within the range of from 280 to 320° K, is recycled to compressor 33 and the lower temperature refrigeration cycle starts anew.

Industrial gas, e.g. nitrogen or oxygen, in stream 10 is passed through heat exchanger 130 wherein it is cooled by indirect heat exchange with both the warming first multicomponent refrigerant fluid and the warming second multicomponent refrigerant fluid. The resulting industrial gas is then passed in stream 111 from heat exchanger 130 through heat exchanger 150 wherein it is cooled and preferably liquefied by indirect heat exchange with warming expanded second multicomponent refrigerant fluid to produce cooled and preferably liquefied industrial gas 12. Although not shown, it should be understood that liquefied gas 12 can be at an elevated pressure level. Hence, it could then be expanded and phase separated so that the low pressure liquid would pass to storage or to a use point whereas the low pressure gas would be rewarmed through heat exchangers 150 and 130 and recombined with feed gas 10 at the warm end. As is well known in the art, the low pressure gas may require some compression to allow its addition to the feed gas 10.

Those skilled in the art will recognize that the invention may be practiced with more than the two refrigeration circuits illustrated in the Drawings. For example, the invention may be practiced with a system having three or more refrigeration circuits. In such situations the first and second multicomponent refrigerant circuits of this invention could be two upper temperature circuits, two lower temperature circuits or two intermediate temperature circuits.

In FIG. 1 there is employed a single core brazed aluminum heat exchanger 100 having two sections 130 and 150. The upper or warmer temperature section 130 has five passes and the lower or cooler temperature section 150 has three passes. The warming expanded first multicomponent refrigerant fluid serves to directly cool the industrial gas in addition to cooling the compressed first multicomponent refrigerant fluid and the compressed second multicomponent refrigerant fluid in conjunction with upper section 130 of single core heat exchanger 100.

Figure 2:
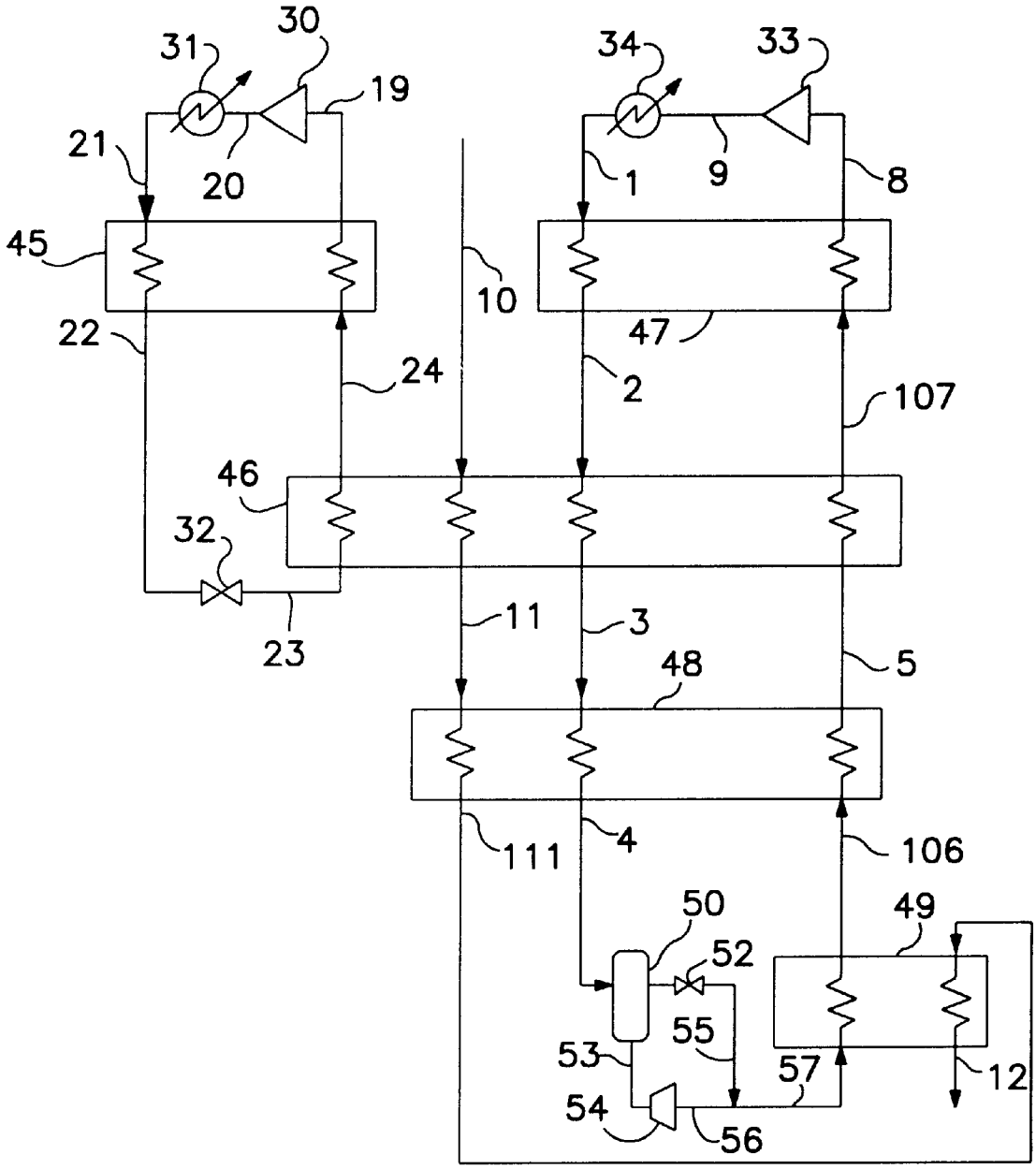
FIG. 2 is a schematic flow diagram of another preferred embodiment of the multiple circuit industrial gas liquefaction system of the invention which additionally employs phase separation and turboexpansion of a mixed refrigerant.

FIG. 2 illustrates another embodiment of the invention employing five heat exchangers and also including the cooling of the industrial gas by indirect heat exchange with the warming expanded first multicomponent refrigerant fluid. These five heat exchangers are numbered 45, 46, 47, 48 and 49. In the embodiment illustrated in FIG. 2 the industrial gas first undergoes cooling at a lower temperature than the highest temperature heat exchange, i.e. in heat exchanger 46 to which is passed stream 23, emerging as stream 24, and also to which is passed stream 5, emerging as stream 107. Also passed to heat exchanger 46 is second multicomponent refrigerant fluid stream 2, emerging therefrom as stream 3. The numerals identifying the fluid streams and the other equipment for this embodiment are the same as those for the embodiment illustrated in FIG. 1 for the common elements which will not be described again in detail.

The embodiment of the invention illustrated in FIG. 2 employs liquid expansion in place of or in addition to the throttling of compressed cooled second multicomponent refrigerant fluid to generate refrigeration. Referring now to FIG. 2, further cooled second multicomponent refrigerant fluid 4 is a two phase stream and is passed into phase separator 50. Vapor 51 from phase separator 50 is throttled through valve 52 to generate refrigeration by the Joule-Thomson effect. Liquid 53 from phase separator 50 is turboexpanded through liquid turbine 54 to generate refrigeration. The two resulting streams 55 and 56 are combined to form refrigeration bearing expanded second multicomponent refrigerant fluid 57 which is warmed to effect the cooling of the compressed second multicomponent refrigerant fluid, and the cooling and preferably liquefaction of the industrial gas in a manner similar to that previously described.

In one preferred embodiment the first multicomponent refrigerant fluid consists solely of fluorocarbons. In another preferred embodiment the first multicomponent refrigerant fluid consists solely of fluorocarbons and hydrofluorocarbons. In another preferred embodiment the first multicomponent refrigerant fluid consists solely of fluorocarbons and atmospheric gases. In another preferred embodiment the first multicomponent refrigerant fluid consists solely of fluorocarbons, hydrofluorocarbons and fluoroethers. In another preferred embodiment the first multicomponent refrigerant fluid consists solely of fluorocarbons, fluoroethers and atmospheric gases.

Although the first multicomponent refrigerant fluid useful in the practice of this invention may contain other components such as hydrochlorofluorocarbons and/or hydrocarbons, preferably the first multicomponent refrigerant fluid contains no hydrochlorofluorocarbons. In another preferred embodiment of the invention the first multicomponent refrigerant fluid contains no hydrocarbons, and most preferably the first multicomponent refrigerant fluid contains neither hydrochlorofluorocarbons nor hydrocarbons. Most preferably the first multicomponent refrigerant fluid is non-toxic, non-flammable and non-ozone-depleting and most preferably every component of the first multicomponent refrigerant fluid is either a fluorocarbon, hydrofluorocarbon, fluoroether or atmospheric gas.

In one preferred embodiment the second multicomponent refrigerant fluid consists solely of fluorocarbons and atmospheric gases. In another preferred embodiment the second multicomponent refrigerant fluid consists solely of fluorocarbons, fluoroethers and atmospheric gases.

Although the second multicomponent refrigerant fluid useful in the practice of this invention may contain other components such as hydrochlorofluorocarbons and/or hydrocarbons, preferably the second multicomponent refrigerant fluid contains no hydrochlorofluorcarbons. In another preferred embodiment of the invention the second multicomponent refrigerant fluid contains no hydrocarbons, and most preferably the second multicomponent refrigerant fluid contains neither hydrochlorofluorcarbons nor hydrocarbons. Most preferably the second multicomponent refrigerant fluid is non-toxic, non-flammable and non-ozone-depleting and most preferably every component of the second multicomponent refrigerant fluid is either a fluorocarbon, hydrofluorocarbon, fluoroether or atmospheric gas.

The invention is particularly advantageous for use in efficiently reaching cryogenic temperatures from ambient temperatures. Tables 1–4 list preferred examples of first multicomponent refrigerant fluid mixtures useful in the practice of this invention. The concentration ranges given in Tables 1–4 are in mole percent.

TABLE 1

| COMPONENT | CONCENTRATION RANGE |
|---|---|
| $C_5F_{12}$ | 5–45 |
| $C_4F_{10}$ | 0–25 |
| $C_3F_8$ | 10–80 |
| $C_2F_6$ | 0–40 |
| $CF_4$ | 0–25 |

TABLE 2

| COMPONENT | CONCENTRATION RANGE |
|---|---|
| $C_5F_{12}$ | 5–45 |
| $C_3H_3F_6$ | 0–25 |
| $C_3F_8$ | 10–80 |
| $CHF_3$ | 0–40 |
| $CF_4$ | 0–25 |

TABLE 3

| COMPONENT | CONCENTRATION RANGE |
|---|---|
| $CHF_2$—O—$C_2HF_4$ | 5–45 |
| $C_4F_{10}$ | 0–25 |
| $CF_3$—O—$CHF_2$ | 0–20 |
| $CF_3$—O—$CF_3$ | 10–80 |
| $C_2F_6$ | 0–40 |
| $CF_4$ | 0–25 |

TABLE 4

| COMPONENT | CONCENTRATION RANGE |
|---|---|
| $C_3H_3F_5$ | 5–45 |
| $C_3H_2F_6$ | 0–25 |
| $CF_3$—O—$CHF_2$ | 10–80 |
| $CHF_3$ | 0–40 |
| $CF_4$ | 0–25 |

Tables 5–10 list preferred examples of second multicomponent refrigerant fluid mixtures useful in the practice of this invention. The concentration ranges given in Tables 5–10 are in mole percent.

TABLE 5

| COMPONENT | CONCENTRATION RANGE |
|---|---|
| $C_5F_{12}$ | 0–25 |
| $C_4F_{10}$ | 0–15 |
| $C_3F_8$ | 0–40 |
| $C_2F_6$ | 0–30 |
| $CF_4$ | 10–50 |
| Ar | 0–40 |
| $N_2$ | 10–80 |

TABLE 6

| COMPONENT | CONCENTRATION RANGE |
|---|---|
| $C_5F_{12}$ | 0–25 |
| $C_4F_{10}$ | 0–15 |
| $C_3F_8$ | 0–40 |
| $CHF_3$ | 0–30 |
| $CF_4$ | 10–50 |
| Ar | 0–40 |
| $N_2$ | 10–80 |

TABLE 7

| COMPONENT | CONCENTRATION RANGE |
|---|---|
| $CHF_2$—O—$C_2HF_4$ | 0–25 |
| $C_4F_{10}$ | 0–15 |
| $CF_3$—O—$CHF_2$ | 0–40 |
| $CF_3$—O—$CF_3$ | 0–20 |
| $C_2F_6$ | 0–30 |
| $CF_4$ | 10–50 |
| Ar | 0–40 |
| $N_2$ | 10–80 |

TABLE 8

| COMPONENT | CONCENTRATION RANGE |
|---|---|
| $C_3H_3F_5$ | 0–25 |
| $C_3H_2F_6$ | 0–15 |
| $CF_3$—O—$CHF_2$ | 0–40 |
| $CHF_3$ | 0–50 |
| $CF_4$ | 10–50 |
| Ar | 0–40 |
| $N_2$ | 10–80 |

TABLE 9

| COMPONENT | CONCENTRATION RANGE |
|---|---|
| $C_3H_3F_5$ | 0–25 |
| $C_3H_2F_6$ | 0–15 |
| $C_2H_2F_4$ | 0–20 |
| $C_2HF_5$ | 0–20 |

TABLE 9-continued

| COMPONENT | CONCENTRATION RANGE |
|---|---|
| $C_2F_6$ | 0–30 |
| $CF_4$ | 10–50 |
| Ar | 0–40 |
| $N_2$ | 10–80 |
| Ne | 0–10 |
| He | 0–10 |

TABLE 10

| COMPONENT | CONCENTRATION RANGE |
|---|---|
| $C_3H_3F_5$ | 0–25 |
| $C_3H_2F_6$ | 0–15 |
| $CF_3$—O—$CHF_2$ | 0–40 |
| $CHF_3$ | 0–30 |
| $CF_4$ | 10–50 |
| Ar | 0–40 |
| $N_2$ | 10–80 |
| Ne | 0–10 |
| He | 0–10 |

The invention is especially useful for providing refrigeration over a wide temperature range, particularly one which encompasses cryogenic temperatures. In a preferred embodiment of the invention each of the two or more components of the either or both of the first and second multicomponent refrigerant mixtures has a normal boiling point which differs by at least 5 degrees Kelvin, more preferably by at least 10 degrees Kelvin, and most preferably by at least 20 degrees Kelvin, from the normal boiling point of every other component in that refrigerant mixture. This enhances the effectiveness of providing refrigeration over a wide temperature range, particularly one which encompasses cryogenic temperatures. In a particularly preferred embodiment of the invention, the normal boiling point of the highest boiling component of the first and/or second multicomponent refrigerant fluid is at least 50° K, preferably at least 100° K, most preferably at least 200° K, greater than the normal boiling point of the lowest boiling component of that multicomponent refrigerant fluid.

The components and their concentrations which make up the first and the second multicomponent refrigerant fluids useful in the practice of this invention are such as to form a variable load multicomponent refrigerant fluid and preferably maintain such a variable load characteristic throughout the whole temperature range of the method of the invention. This markedly enhances the efficiency with which the refrigeration can be generated and utilized over such a wide temperature range. The defined preferred group of components has an added benefit in that they can be used to form fluid mixtures which are non-toxic, non-flammable and low or non-ozone-depleting. This provides additional advantages over conventional refrigerants which typically are toxic, flammable and/or ozone-depleting.

One preferred variable load multicomponent refrigerant fluid which can be used as the first and/or the second multicomponent refrigerant fluid useful in the practice of this invention which is non-toxic, non-flammable and non-ozone-depleting comprises two or more components from the group consisting of $C_5F_{12}$, $CHF_2$—O—$C_2HF_4$, $C_4HF_9$, $C_3H_3F_5$, $C_2F_5$—O—$CH_2F$, $C_3H_2F_6$, $CHF_2$—O—$CHF_2$, $C_4F_{10}$, $CF_3$—O—$C_2H_2F_3$, $C_3HF_7$, $CH_2F$—O—$CF_3$, $C_2H_2F_4$, $CHF_2$—O—$CF_3$, $C_3F_8$, $C_2HF_5$, $CF_3$—O—$CF_3$, $C_2F_6$, $CHF_3$, $CF_4$, $O_2$, Ar, $N_2$, Ne and He.

Although the invention has been described in detail with reference to certain preferred embodiments, those skilled in the art will recognize that there are other embodiments of the invention within the spirit and the scope of the claims. For example, the invention may be employed to cool or to cool and liquefy two or more industrial gas streams rather than the single industrial gas stream shown in the Drawings.

What is claimed is:

1. A method for cooling an industrial gas comprising:

(A) compressing a first multicomponent refrigerant fluid comprising at least one component from the group consisting of fluorocarbons, hydrofluorocarbons and fluoroethers and at least one component from the group consisting of fluorocarbons, hydrofluorocarbons, fluoroethers and atmospheric gases;

(B) cooling the compressed first multicomponent refrigerant fluid and expanding the cooled compressed first multicomponent refrigerant fluid to generate refrigeration;

(C) warming the expanded first multicomponent refrigerant fluid by indirect heat exchange with the compressed first multicomponent refrigerant fluid to effect said cooling of the compressed first multicomponent refrigerant fluid;

(D) compressing a second multicomponent refrigerant fluid comprising at least one component from the group consisting of fluorocarbons, hydrofluorocarbons and fluoroethers and at least one atmospheric gas;

(E) warming the expanded first multicomponent refrigerant fluid by indirect heat exchange with the compressed second multicomponent refrigerant fluid to cool the compressed second multicomponent refrigerant fluid;

(F) further cooling the cooled compressed second multicomponent refrigerant fluid and expanding the further cooled second multicomponent refrigerant fluid to generate refrigeration;

(G) warming the expanded second multicomponent refrigerant fluid by indirect heat exchange with the compressed second multicomponent refrigerant fluid to effect said further cooling of the compressed second multicomponent refrigerant fluid; and (H) warming the expanded second multicomponent refrigerant fluid by indirect heat exchange with industrial gas to cool said industrial gas.

2. The method of claim 1 wherein the cooled industrial gas is liquid.

3. The method of claim 1 further comprising cooling the industrial gas by indirect heat exchange with expanded first multicomponent refrigerant fluid.

4. The method of claim 1 wherein the expansion of the further cooled second multicomponent refrigerant fluid is a Joule-Thomson expansion.

5. The method of claim 1 wherein the expansion of the further cooled second multicomponent refrigerant fluid is, at least in part, a turboexpansion.

6. The method of claim 1 wherein the first multicomponent refrigerant fluid comprises at least one component from the group consisting of fluorocarbons, hydrofluorocarbons and fluoroethers and at least one atmospheric gas.

7. The method of claim 1 wherein the first multicomponent refrigerant fluid comprises at least one fluoroether and at least one component from the group consisting of fluorocarbons, hydrofluorocarbons, fluoroethers and atmospheric gases.

8. The method of claim 1 wherein the second multicomponent refrigerant fluid comprises at least two components from the group consisting of fluorocarbons, hydrofluorocarbons and fluoroethers and at least two atmospheric gases.

9. The method of claim 1 wherein at least one of the first and second multicomponent refrigerant fluids comprises at least two components from the group consisting of $C_5F_{12}$, $CHF_2—O—C_2HF_4$, $C_4HF_9$, $C_3H_3F_5$, $C_2F_5—O—CH_2F$, $C_3H_2F_6$, $CHF_2—O—CHF_2$, $C_4F_{10}$, $CF_3—O—C_2H_2F_3$, $C_3HF_7$, $CH_2F—O—CF_3$, $C_2H_2F_4$, $CHF_2—O—CF_3$, $C_3F_8$, $C_2HF_5$, $CF_3—O—CF_3$, $C_2F_6$, $CHF_3$, $CF_4$, $O_2$, Ar, $N_2$, Ne and He.

10. The method of claim 1 wherein at least one of the first and second multicomponent refrigerant fluids is a variable load multicomponent refrigerant fluid throughout the whole temperature range of the method.

* * * * *